US011085455B1

(12) United States Patent
Combs et al.

(10) Patent No.: US 11,085,455 B1
(45) Date of Patent: Aug. 10, 2021

(54) SYSTEM FOR REGULATING AIRFLOW ASSOCIATED WITH PRODUCT FOR SALE

(71) Applicant: DELTA T, LLC, Lexington, KY (US)

(72) Inventors: Joshua D. Combs, Lexington, KY (US); Coleman M. Stivers, Lexington, KY (US); Michael S. Robinson, Berea, KY (US); Thomas James Lesser, Lexington, KY (US); Christian R. Taber, Lexington, KY (US); Jonathan W. W. Olsen, Lexington, KY (US)

(73) Assignee: Delta T, LLC, Lexington, KY (US)

( * ) Notice: Subject to any disclaimer, the term of this patent is extended or adjusted under 35 U.S.C. 154(b) by 812 days.

(21) Appl. No.: 14/823,495

(22) Filed: Aug. 11, 2015

Related U.S. Application Data

(60) Provisional application No. 62/035,667, filed on Aug. 11, 2014.

(51) Int. Cl.
*F04D 27/00* (2006.01)
*F04D 19/00* (2006.01)

(52) U.S. Cl.
CPC ..... *F04D 27/006* (2013.01); *F04D 19/002* (2013.01)

(58) Field of Classification Search
CPC ..... F04D 19/002; F04D 27/006
USPC ..... 62/177, 125, 126, 249, 251, 252, 253, 62/254, 255, 256
See application file for complete search history.

(56) References Cited

U.S. PATENT DOCUMENTS 493,305 A * 3/1893 Sherman ..... F04D 29/601 416/246
1,772,296 A * 8/1930 Strobell ..... F04D 25/08 415/125
1,938,889 A * 12/1933 Bloom ..... A23B 7/148 99/469
2,213,582 A 9/1940 Hall
2,275,772 A * 3/1942 Koch ..... F24C 15/20 126/299 D
2,444,887 A * 7/1948 Wyeth ..... F25D 23/12 312/198
2,904,254 A * 9/1959 Bahnson, Jr. ..... F24F 3/14 236/44 C
2,929,227 A * 3/1960 Rainwater ..... A47F 3/0443 62/256
2,993,349 A * 7/1961 Detwiler ..... A47F 3/0452 62/256
3,009,333 A * 11/1961 Rainwater ..... A47F 3/0443 62/256
3,018,712 A * 1/1962 Wacker ..... F24F 9/00 454/192
3,067,522 A * 12/1962 Teigen ..... A23B 7/148 34/475

(Continued)

FOREIGN PATENT DOCUMENTS

CA 2717398 A1 * 8/2009
CA 2717398 C * 8/2009

(Continued)

*Primary Examiner* — Ljiljana V. Ciric
(74) *Attorney, Agent, or Firm* — Dickinson Wright PLLC

(57) ABSTRACT

A system for displaying the produce for sale and at least one sensor for sensing a parameter associated with the display and generating an output representative of the parameter. An overhead fan located in the space above the display regulates the airflow over the display. A controller is provided for controlling the fan based on the output of the sensor.

12 Claims, 5 Drawing Sheets

(56) References Cited

U.S. PATENT DOCUMENTS 3,102,777 A * 9/1963 Bedrosian ..... B65D 88/745 422/40
3,170,541 A * 2/1965 Werner ..... A47J 37/06 186/44
3,228,317 A * 1/1966 Westman ..... A47C 7/74 454/338
3,287,929 A * 11/1966 Beckwith ..... A47F 3/0447 454/193
3,289,432 A * 12/1966 Brennan ..... A47F 3/0447 62/256
3,306,068 A * 2/1967 Allgeyer ..... A47F 3/0447 62/255
3,324,676 A * 6/1967 Gerweck ..... A47F 3/0447 62/256
3,365,908 A * 1/1968 Macmaster ..... A47F 3/0447 62/256
3,369,375 A * 2/1968 Gerweck ..... A47F 3/0447 62/256
3,392,543 A * 7/1968 Miller ..... A47F 3/0443 62/237
3,392,544 A * 7/1968 Perez ..... A47F 3/0447 62/256
3,403,525 A * 10/1968 Beckwith ..... A47F 3/0447 454/193
3,496,732 A * 2/1970 Hermanson ..... F25D 29/00 62/80
3,499,295 A * 3/1970 Brennan ..... F25B 40/02 62/81
3,517,526 A * 6/1970 Macmaster ..... A47F 3/0447 454/193
3,531,945 A * 10/1970 Brennan ..... F25D 17/06 62/234
3,593,538 A * 7/1971 Bachman ..... A01G 5/06 62/256
3,648,482 A * 3/1972 Beckwith ..... A47F 3/0447 62/256
3,675,440 A * 7/1972 Ibrahim ..... A47F 3/0447 62/256
3,690,118 A * 9/1972 Rainwater ..... A47F 3/0447 62/250
3,696,630 A * 10/1972 Bressickello ..... A01G 5/04 62/188
3,712,078 A * 1/1973 Maynard ..... F25D 19/00 62/448
3,771,323 A * 11/1973 Simons ..... A47F 3/0447 454/193
3,812,684 A * 5/1974 Brown ..... A47F 3/0447 454/193
3,827,254 A * 8/1974 MacMaster ..... A47F 3/0447 62/256
3,836,220 A * 9/1974 Ishammar ..... F25D 19/00 312/236
3,850,003 A * 11/1974 Beckwith ..... A47F 3/0447 62/256
3,933,006 A * 1/1976 South ..... A47F 3/0443 62/231
3,937,033 A * 2/1976 Beckwith ..... A47F 3/0447 62/155
4,030,476 A * 6/1977 Hock ..... A47J 39/003 126/246
4,117,698 A * 10/1978 Vogel ..... A47F 3/0447 312/116
4,132,216 A * 1/1979 Guibert ..... F25D 25/00 126/21 A
4,144,720 A * 3/1979 Subera ..... A47F 3/0447 415/149.2
4,145,893 A * 3/1979 Vogel ..... A47F 3/0447 62/151
4,267,706 A * 5/1981 Abraham ..... A47F 3/0447 62/256
4,269,037 A * 5/1981 Karashima ..... A47F 3/0447 62/256
4,299,092 A * 11/1981 Ibrahim ..... F25D 21/125 62/256
4,302,946 A * 12/1981 Ibrahim ..... A47F 3/0447 62/234
4,326,385 A * 4/1982 Ibrahim ..... F25D 21/125 62/256
4,341,081 A * 7/1982 Ibrahim ..... A47F 3/0447 62/151
4,369,632 A * 1/1983 Abraham ..... A47F 3/0408 62/256
4,414,822 A * 11/1983 Ibrahim ..... A47F 3/0447 62/151
4,458,501 A * 7/1984 Kooy ..... A01G 5/06 312/116
4,608,776 A * 9/1986 Kooy ..... A01G 5/06 312/116
4,633,677 A * 1/1987 Maehara ..... A47F 3/0447 62/256
4,648,247 A * 3/1987 Takizawa ..... A47F 3/0447 62/256
4,680,942 A * 7/1987 Kooy ..... A01G 5/06 62/256
4,753,496 A * 6/1988 Bussard ..... F24F 7/065 312/116
4,777,806 A * 10/1988 Perez ..... A47F 3/0447 62/256
4,938,034 A * 7/1990 Rosanio ..... A47F 3/0447 62/256
5,048,303 A * 9/1991 Campbell ..... A47F 3/0447 62/256
5,086,627 A * 2/1992 Borgen ..... A47F 3/0408 62/229
5,114,016 A * 5/1992 Todd ..... A47F 5/108 211/206
5,138,843 A * 8/1992 Tamayama ..... A47F 3/0447 62/256
5,167,365 A * 12/1992 Mitoshi ..... G05D 23/1917 236/49.3
5,189,412 A * 2/1993 Mehta ..... G05B 19/108 340/12.24
5,240,320 A * 8/1993 Yerman ..... A47B 57/52 312/236
5,242,054 A * 9/1993 Todd ..... A47F 5/04 206/497
5,273,402 A * 12/1993 Maury ..... F04D 29/646 248/125.1
5,277,486 A * 1/1994 Bustos ..... A47F 3/0408 211/151
5,316,214 A 5/1994 Suzuki et al.
5,336,049 A * 8/1994 Herman ..... A47F 3/0439 312/236
5,345,778 A * 9/1994 Roberts ..... A47F 3/0447 62/256
5,357,767 A * 10/1994 Roberts ..... A47F 3/0447 454/193
5,397,268 A * 3/1995 Chang ..... A45B 3/00 297/184.1
5,477,702 A * 12/1995 Kennedy ..... A47F 3/0447 62/256
5,522,704 A * 6/1996 Casteel ..... F04D 29/601 362/404
5,549,373 A * 8/1996 Bustos ..... A47F 3/0408 312/125
5,599,079 A * 2/1997 Ranno ..... A47F 3/0486 108/108
5,675,983 A * 10/1997 Ibrahim ..... A47F 3/0408 62/255
5,743,102 A * 4/1998 Thomas ..... A47F 3/04 165/219
5,845,886 A * 12/1998 McCormick ..... F04D 25/088 248/200.1
5,953,929 A * 9/1999 Bauman ..... F25D 19/00 62/237
6,014,867 A * 1/2000 Fløysvik ..... A47F 3/0443 62/255

(56) References Cited

U.S. PATENT DOCUMENTS 6,128,911 A * 10/2000 Mathews ..... A47F 3/0408 62/256
6,138,460 A * 10/2000 Lee ..... F25D 17/065 62/186
6,244,821 B1 * 6/2001 Boyd ..... F04D 25/088 416/210 R
6,257,010 B1 * 7/2001 Shei ..... A47F 3/04 165/48.1
6,367,274 B1 * 4/2002 Mellado ..... A47F 3/0447 62/255
6,460,372 B1 * 10/2002 Fung ..... A47F 3/0469 165/150
6,467,695 B1 10/2002 Riley et al.
6,467,696 B2 10/2002 Riley et al.
6,481,635 B2 11/2002 Riley et al.
6,578,376 B2 * 6/2003 Thurman ..... A47F 3/0404 62/246
6,615,593 B2 * 9/2003 Thurman ..... A47F 3/0404 62/256
6,672,092 B2 * 1/2004 Ruiz ..... A47F 3/001 62/246
6,701,739 B2 * 3/2004 Morse ..... F25D 19/00 62/277
6,722,149 B1 * 4/2004 Saroka ..... A47F 3/0447 454/193
6,745,588 B2 * 6/2004 Kahler ..... A47F 3/0486 211/169.1
6,775,994 B1 * 8/2004 Math ..... A47F 3/0447 62/186
6,939,108 B2 * 9/2005 Boyd ..... F01D 5/147 416/210 R
6,959,560 B2 * 11/2005 Weikel ..... A47F 3/0447 62/255
6,981,385 B2 * 1/2006 Arshansky ..... A47F 3/0482 62/155
7,097,111 B2 8/2006 Iley et al.
7,158,863 B1 * 1/2007 Johnson ..... A47F 3/0447 62/256
7,162,882 B2 * 1/2007 Alahyari ..... A47F 3/0447 62/256
7,284,960 B2 * 10/2007 Aynsley ..... F04D 29/384 416/223 R
7,374,138 B2 * 5/2008 Marshall ..... A47F 7/00 108/49
7,422,163 B1 * 9/2008 DeVorss ..... F04D 25/088 239/209
D607,988 S * 1/2010 Oleson ..... D23/377
7,681,409 B2 * 3/2010 Alahyari ..... A47F 3/0447 62/255
7,703,466 B1 * 4/2010 Smith ..... E04H 15/10 135/91
8,713,954 B2 * 5/2014 Stephens ..... A47F 3/0447 62/256
8,900,041 B2 * 12/2014 Toy ..... F24F 7/007 454/258
9,003,820 B2 * 4/2015 Veltrop ..... A47J 36/2483 62/229
9,101,222 B2 * 8/2015 Minkoff ..... A47C 7/744
9,220,354 B2 * 12/2015 Nguyen ..... A47F 3/0447
9,456,706 B2 * 10/2016 Nguyen ..... A47F 3/0443
9,618,222 B1 * 4/2017 Hussain ..... F24F 11/30
9,675,185 B2 * 6/2017 Anderson ..... A47F 3/0447
9,775,448 B2 * 10/2017 Wood ..... A47F 3/0447
9,814,326 B2 * 11/2017 Choueifati ..... A47F 3/0447
9,856,883 B1 * 1/2018 Olsen ..... F24F 13/22
9,974,211 B2 * 5/2018 Boegner ..... G05D 7/0623
10,219,638 B2 * 3/2019 Wood ..... A47F 3/0447
10,309,663 B1 * 6/2019 Taber ..... F24F 3/14
10,337,790 B2 * 7/2019 Sato ..... B60H 1/00014
10,646,054 B2 * 5/2020 Watanabe ..... A47F 3/0478
10,801,508 B2 * 10/2020 Johnson ..... F04D 25/088
2001/0042383 A1 * 11/2001 Chiang ..... F25B 41/043 62/246
2001/0042384 A1 * 11/2001 Chiang ..... F25B 41/043 62/246
2002/0017571 A1 2/2002 Riley et al.
2002/0162346 A1 * 11/2002 Chiang ..... A47F 3/0447 62/246
2002/0176809 A1 * 11/2002 Siess ..... B03C 3/00 422/121
2003/0084676 A1 * 5/2003 Thurman ..... A47F 3/0404 62/256
2003/0172670 A1 * 9/2003 Vormedal ..... F25D 23/023 62/407
2004/0055321 A1 * 3/2004 Kempiak ..... A47F 3/0443 62/255
2004/0123613 A1 * 7/2004 Chiang ..... A47F 3/0443 62/246
2004/0163401 A1 * 8/2004 Alahyari ..... A47F 3/0447 62/256
2004/0168456 A1 * 9/2004 Chiang ..... A47F 3/0447 62/246
2005/0138943 A1 * 6/2005 Alahyari ..... A47F 3/0447 62/256
2005/0141997 A1 * 6/2005 Rast ..... F04D 27/008 416/229 R
2006/0071774 A1 * 4/2006 Brown ..... G07F 9/026 340/522
2006/0165529 A1 * 7/2006 Sobel ..... F04D 25/088 416/210 R
2007/0006604 A1 * 1/2007 Behr ..... A47F 3/0443 62/246
2007/0158443 A1 7/2007 Boudreau et al.
2008/0001747 A1 * 1/2008 Kangas ..... G08B 13/2462 340/572.1
2008/0008596 A1 * 1/2008 Aynsley ..... F04D 29/384 416/243
2008/0149604 A1 * 6/2008 Varriano-Marston ..... B23K 26/382 219/121.72
2008/0282719 A1 * 11/2008 Fung ..... A47F 3/0443 62/255
2008/0294487 A1 * 11/2008 Nasser ..... G06Q 30/0203 705/7.32
2008/0294488 A1 * 11/2008 Gupta ..... G06Q 10/087 705/7.26
2009/0006295 A1 * 1/2009 Angell ..... G06N 3/004 706/21
2009/0014545 A1 * 1/2009 Horiuchi ..... F24F 7/06 236/49.3
2009/0084125 A1 * 4/2009 Fung ..... A47F 3/0447 62/255
2009/0097975 A1 * 4/2009 Aynsley ..... F04D 29/601 416/32
2009/0162197 A1 * 6/2009 Klemo ..... F04D 29/662 416/1
2009/0205351 A1 * 8/2009 Fung ..... A47F 3/0447 62/256
2009/0208333 A1 * 8/2009 Smith ..... F04D 25/088 416/5
2009/0215381 A1 * 8/2009 Swofford ..... A47F 3/0447 454/193
2010/0192600 A1 * 8/2010 Schenk ..... A47F 3/0413 62/89
2010/0278637 A1 * 11/2010 Oleson ..... F04D 25/088 415/121.3
2010/0291858 A1 * 11/2010 Toy ..... F04D 19/002 454/258
2011/0173082 A1 * 7/2011 Breitenbach ..... G06Q 10/06311 705/16
2011/0192213 A1 * 8/2011 Zimmerman ..... A01K 5/02 73/23.3
2012/0054061 A1 * 3/2012 Fok ..... A01G 13/0268 705/26.5
2012/0294876 A1 * 11/2012 Zimmerman ..... A61B 5/082 424/184.1

(56) References Cited

U.S. PATENT DOCUMENTS

2013/0019621 A1* 1/2013 Wood ..... A47F 3/0447 62/126
2013/0073431 A1* 3/2013 Suro ..... G06Q 30/0623 705/26.61
2013/0189109 A1* 7/2013 Noble ..... F04D 29/384 416/219 R
2013/0269541 A1* 10/2013 Carter ..... A47F 3/001 99/483
2013/0327070 A1* 12/2013 Rees ..... F25D 21/04 62/80
2014/0023507 A1* 1/2014 Smith ..... F04D 29/329 416/204 R
2014/0123691 A1* 5/2014 Shapiro ..... F25B 49/022 62/115
2014/0260360 A1* 9/2014 Rasch ..... A47F 3/0478 62/80
2014/0313055 A1* 10/2014 Warkentin ..... G01N 33/02 340/870.16
2014/0338383 A1* 11/2014 Simadiris ..... B64D 11/04 62/177
2014/0348649 A1* 11/2014 Oleson ..... F04D 29/522 415/208.1
2014/0379817 A1* 12/2014 Logue ..... G06Q 10/107 709/206
2015/0013226 A1* 1/2015 Artwohl ..... F25D 23/02 49/25
2015/0086383 A1* 3/2015 Toy ..... F04D 27/02 417/32
2015/0204561 A1* 7/2015 Sadwick ..... F24F 11/30 236/1 C
2016/0058207 A1* 3/2016 Choueifati ..... A47F 3/0447 62/256
2016/0085248 A1* 3/2016 Gordon ..... G05D 23/1932 700/276
2016/0235218 A1* 8/2016 Nuttall ..... A47F 3/001
2016/0235219 A1* 8/2016 Aamodt ..... A61L 9/14
2016/0374177 A1* 12/2016 Chen ..... F21V 33/0096
2017/0016451 A1* 1/2017 Desmet ..... F04D 25/08
2017/0089348 A1* 3/2017 Banks ..... F24F 11/30
2017/0115019 A1* 4/2017 Desmet ..... G05D 27/02
2017/0142249 A1* 5/2017 Shinar ..... H04L 12/282
2017/0202039 A1* 7/2017 Logue ..... H04W 4/029
2017/0205105 A1* 7/2017 Adam ..... F04D 27/004
2017/0370366 A1* 12/2017 Johnson ..... F24F 11/30
2018/0007453 A1* 1/2018 Taylor ..... G01N 33/02
2018/0042186 A1* 2/2018 Kop ..... A01G 9/20
2018/0119979 A1* 5/2018 Reed ..... G05B 15/02
2018/0123818 A1* 5/2018 Shinar ..... G08C 17/02
2019/0056128 A1* 2/2019 Jacob ..... B01D 46/0027
2019/0079479 A1* 3/2019 Weeks, Jr. ..... F04D 27/007
2019/0285078 A1* 9/2019 Toy ..... F04D 27/004
2020/0370441 A1* 11/2020 Bhosale ..... F24F 1/06

FOREIGN PATENT DOCUMENTS

EP 2250452 B1 * 5/2019
WO WO-2009100052 A1 * 8/2009

* cited by examiner

SYSTEM FOR REGULATING AIRFLOW ASSOCIATED WITH PRODUCT FOR SALE

This patent application claims the benefit of U.S. Provisional Patent Application Ser. No. 62/035,667, the disclosure of which is incorporated herein by reference. The disclosure of U.S. patent application Ser. No. 14/685,897 is incorporated herein by reference.

TECHNICAL FIELD

This application relates generally to the air handling arts and, more particularly, to a system and method involving the regulated use of a fan to control airflow associated with product offered for sale, such as for example produce subject to spoilage.

BACKGROUND OF THE INVENTION

The respiration and microbial activity associated with certain types of products, such as fruit, increases dramatically with increasing temperature. Certain types of produce generate heat as they ripen, which in turn increases respiration and microbial activity. Increased microbial activity causes spoilage, while increased respiration causes the commodity to produce more ethylene which in turn causes the fruit to ripen quicker.

Moisture is also a consideration. Produce stored in an environment that has a relative humidity of less than 100% (vapor pressure deficit) will release moisture to the surrounding air. At low temperatures (refrigeration), high humidity is beneficial to produce life because it prevents moisture loss, which is a key component in quality degradation of produce. However, high humidity at higher temperatures is not necessarily beneficial to shelf life. High humidity combined with room temperatures creates ideal conditions for microbial growth and spoilage.

Surface moisture can also be created by condensation, such as when a cold object moves from a cold space with a low absolute humidity to a thermally comfortable space. Surface moisture on produce encourages microbial growth even more than high relative humidity, since it hydrates and activates dormant microbes and makes nutrients available in an aqueous solution for microbial growth.

Accordingly, a need is identified to address the foregoing issues and thereby prolong the useful life of the produce by retarding spoilage by regulating the operation of one or more fans for circulating air in a space including the produce. A related need is to avoid causing discomfort to consumers and/or disrupting air curtains associated with open air refrigeration cases in the space.

SUMMARY

In accordance with one aspect of the disclosure, a system for regulating airflow associated with product in a space is provided. The system comprises a display in the space for displaying the product for sale. At least one sensor is provided for sensing a parameter associated with the display and generating an output representative of the parameter. An overhead fan is located in the space adjacent to the display, and a controller is provided for controlling the fan based on the output of the sensor.

In one embodiment, the sensor is supported by the display or connected to the fan. The parameter sensed by the sensor may be selected from the group consisting of air temperature, surface temperature of the product, relative humidity, and $CO_2$ concentration. The system may further include a sensor node with the at least one sensor, which node is adapted for sensing air temperature, surface temperature, relative humidity, and $CO_2$ concentration. An occupancy sensor may be provided for determining the presence of a person adjacent to the display, and the controller may be adapted to override the control based on a sensor output when occupancy is detected. An HVAC system for conditioning air in the space may also be in communication with the controller.

The display may comprise a pallet including an electronic tag for identifying at least the location of the pallet relative to the fan. The sensor may be adapted for sensing a surface temperature of the product, and the controller may be adapted for predicting a temperature within a pile of product based on the sensed surface temperature and for using the predicted temperature to regulate the fan. The display may alternatively comprise a refrigerated open air case including an air curtain and the controller may be adapted to control the fan to avoid disrupting the air curtain. In one embodiment, the sensor comprises a temperature sensor for positioning at least partially within the air curtain, and the controller is adapted to regulate the fan based on the output of the temperature sensor. The system may further include a refrigerated open air case including an air curtain, and wherein the controller is adapted to control the fan to avoid disrupting the air curtain.

Another aspect of the disclosure relates to a method of assisting in regulating airflow in connection with a product. The method involves displaying the product for sale on a display in a space, and regulating an overhead fan in the space adjacent to the product based on at least one condition associated with the product display. The condition may comprise a condition of the product determined by sensing a parameter selected from the group consisting of air temperature, surface temperature, relative humidity, and $CO_2$ concentration.

The method may further include the step of regulating the fan based on the detection of a person adjacent to the display. The regulating step may be performed based on a condition selected from the group consisting of a type of product, a time of day, a concentration of $CO_2$, a relative humidity, or any combination of the foregoing. The regulating step may be performed by predicting a temperature within a pile of product based on a sensed surface temperature of the pile.

Additionally, the step of regulating the fan may comprise operating the fan at a first speed based on a detected difference in a temperature associated with the product at the at least one condition associated with the display and an ambient dewpoint temperature. The method may further include the step of regulating the fan at a second speed lower than the first speed when the temperature of the product exceeds the ambient dewpoint temperature. The second speed may comprise a minimum speed not to cause discomfort if occupancy is detected adjacent to the display.

The regulating step may comprise regulating the fan at a speed necessary to maintain a sensed surface temperature of the product within a predetermined amount above an ambient air dew point temperature. Alternatively, the regulating step may comprise regulating an HVAC system. The method may further include the step of overriding the regulating step if one of a person or an air curtain is located adjacent to the display. In a further aspect of the method, the condition comprises a sensed temperature of an air curtain associated with a refrigerated open air case serving as the display, and the regulating step comprises regulating the fan to avoid disrupting the air curtain.

Still another aspect of the disclosure pertains to a system for regulating airflow associated with product on display for sale. The system comprises a plurality of displays in the space, each for displaying a different type of product for sale. At least one sensor is provided for sensing a parameter associated with each display and generating an output representative of the parameter. At least one overhead fan may be associated with each display for regulating an airflow adjacent thereto. A controller is also provided for controlling the fans based on the output of the sensors.

In one embodiment, the controller is adapted to regulate the at least one fan based on the type of product on the display associated with the at least one fan. The system may further include an interface for allowing a user to communicate to the controller an identification relating to the type of product on the display. The product is associated with an electronic identifier used by the controller to control the associated fan.

At least one of the displays may comprise a refrigerated open air case including an air curtain. The controller may be adapted for controlling the at least one overhead fan to avoid disrupting the air curtain. The at least one sensor may comprise a temperature probe for positioning within the air curtain.

Still another aspect of the invention relates to a system for regulating airflow in a space. The system comprises a fan for circulating air within the space. A first sensor for sensing $CO_2$ within the space and generating a first output is also provided, as is a controller for controlling the operation of the fan based on the first output of the first sensor. The space may include a display for supporting produce for sale. The system may further include a second sensor for detecting one of temperature or humidity and generating a second output signal used by the controller to regulate the fan.

Yet another aspect of the disclosure relates to a method of regulating airflow in a space. The method comprises regulating a fan based on a sensed amount of $CO_2$ within the space. The method may further include the step of providing produce in the space, and wherein the sensed $CO_2$ is representative of ethylene gas emanating from the produce.

Another aspect of the disclosure relates to a method of retarding the spoilage of produce. The method comprises regulating the operation of a fan based on the type of produce influenced by an airflow generated by the fan.

A system for providing airflow in a space is also disclosed. The system comprises a first display in the space for displaying a first type of produce, a first fan for providing airflow to the first type of produce, a second display in the space for displaying a second type of produce, a second fan for providing airflow to the second type of produce, and a controller for controlling the operation of the first fan and the second fan based on the first and second types of produce.

The disclosure also pertains to a system for regulating airflow. The system comprises a display in the space including an air curtain. A sensor for positioning within the air curtain is also provided, along with an overhead fan located in the space above the display for regulating the airflow. A controller is provided for controlling the fan based on the output of the sensor.

Also, this disclosure relates to a method for regulating airflow for a product display in association with an air curtain of a refrigerated open air case. The method comprises regulating an overhead fan to provide airflow for the product display while avoiding disrupting the air curtain of the refrigerated open air case. The method further includes the step of sensing a temperature of the air curtain using a sensor associated with the case, and regulating the fan based on the sensed temperature.

DETAILED DESCRIPTION OF THE INVENTION

Figure 1:
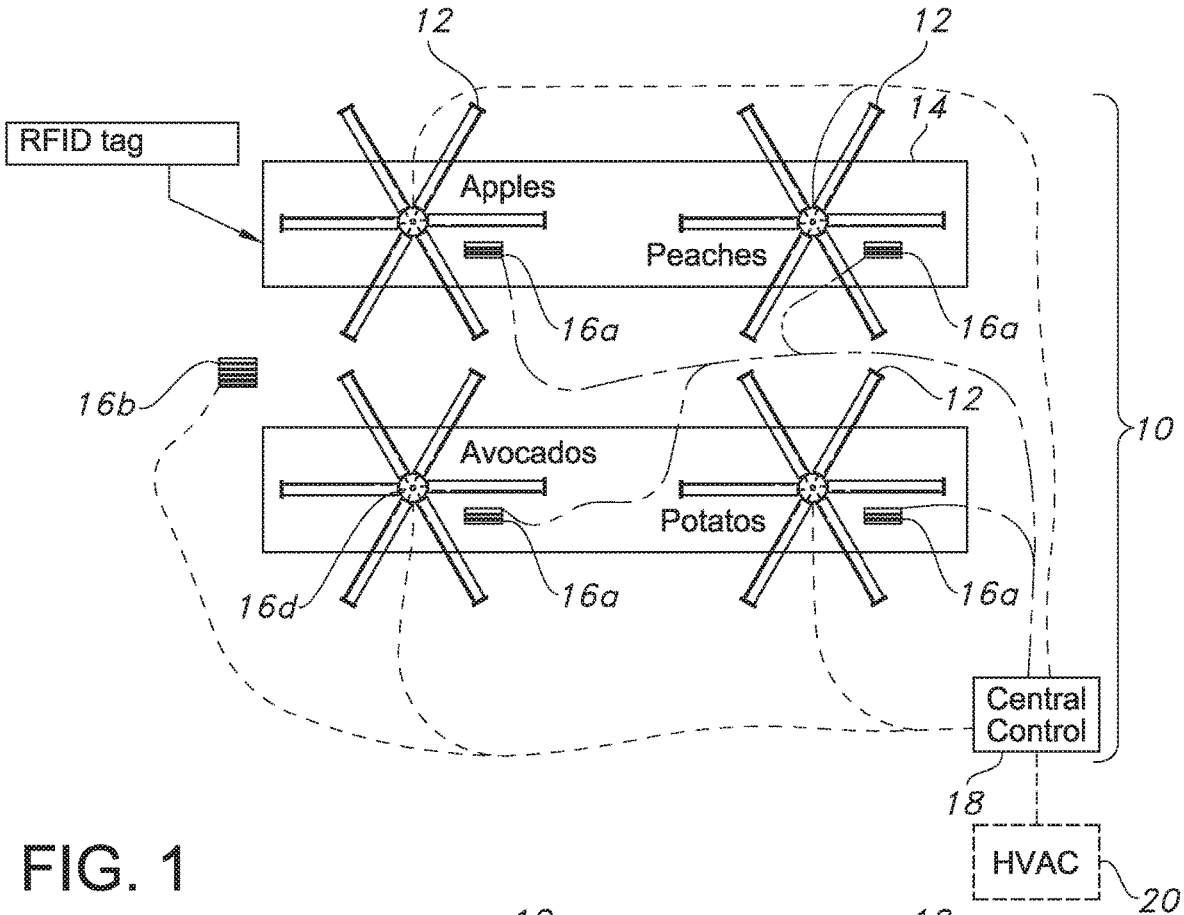
FIG. 1 is a top schematic view of one embodiment of the system.

In accordance with one aspect of the invention, one or more fans may be used to regulate airflow delivered to one or more products, such as in connection with the regulation of an HVAC system and/or one or more sensors for sensing conditions associated with the product. In one exemplary embodiment, a system 10 is provided that uses one or more fans 12, which may be provided adjacent to the product under consideration. In the example shown in the figures, the fan 12 comprises an overhead fan (i.e., a ceiling fan, even though it need not be mounted directly to the ceiling) mounted above a collection of product, which may be of any type or possibly a variety of types, including for instance produce in the form of fresh fruit or vegetables.

The fan(s) 12 need not be of any particular type, but there is a preference for high volume, low speed fans, as disclosed in U.S. Pat. No. 7,284,960, entitled "Fan Blades," issued Oct. 23, 2007; U.S. Pat. No. 6,244,821, entitled "Low Speed Cooling Fan," issued Jun. 12, 2001; U.S. Pat. No. 6,939,108, entitled "Cooling Fan with Reinforced Blade," issued Sep. 6, 2005; and U.S. Pat. No. D607,988, entitled "Ceiling Fan," issued Jan. 12, 2010, U.S. Pat. Pub. No. 2008/0008596, entitled "Fan Blades," published Jan. 10, 2008; U.S. Pat. Pub. No. 2009/0208333, entitled "Ceiling Fan System with Brushless Motor," published Aug. 20, 2009; and U.S. Pat. Pub. No. 2010/0278637, entitled "Ceiling Fan with Variable Blade Pitch and Variable Speed Control," published Nov. 4, 2010, the disclosures of which are all incorporated by reference herein.

As illustrated, the product may be provided on display for sale by way of a display 14. The display 14 may comprise a stand, table, bin, pallet, or like structure for supporting the product, usually in a stacked or pile form. While exposed to the ambient environment and not fully contained, the product may in some situations be located in shipping boxes or cartons, which as a result of display 14 may be located above the floor of an associated space (which may for example be the produce section of a retail grocery or warehouse store, but could also be a storage area for holding the produce prior to display for sale). The display 14 may be an elongated structure, and may support different types of product in different zones, as will be understood upon reviewing the following description. The term display may also be considered to include separate structures used to support a type of product for sale, and need not comprise a single unitary structure.

The system 10 may operate such that one or more parameters relating to one or more conditions of the product are sensed and used to regulate the operation of the associated fan(s) 12. For instance, one or more sensors may be provided adjacent to the product (such as by being embedded within the product arranged in a stack or pile form or otherwise connected to the display 14) for sensing one or more of air temperature, surface temperature, relative humidity, and $CO_2$ concentration (which correlates to ethylene production by produce). The output from the sensor(s) may then be used to regulate the operation of the fan(s) 12.

As an example, and as shown in FIG. 1, one or more sensors may be provided as a sensor node 16*a* supported by the display 14 for detecting conditions of the product, while sensors may also be provided as part of a more remote node 16*b* for sensing ambient conditions. As can be appreciated from FIG. 1, more than one sensor or sensor node 16*a* may be associated with each display 14, including for sensing conditions relative to more than one type of product associated with the display.

Figure 2:
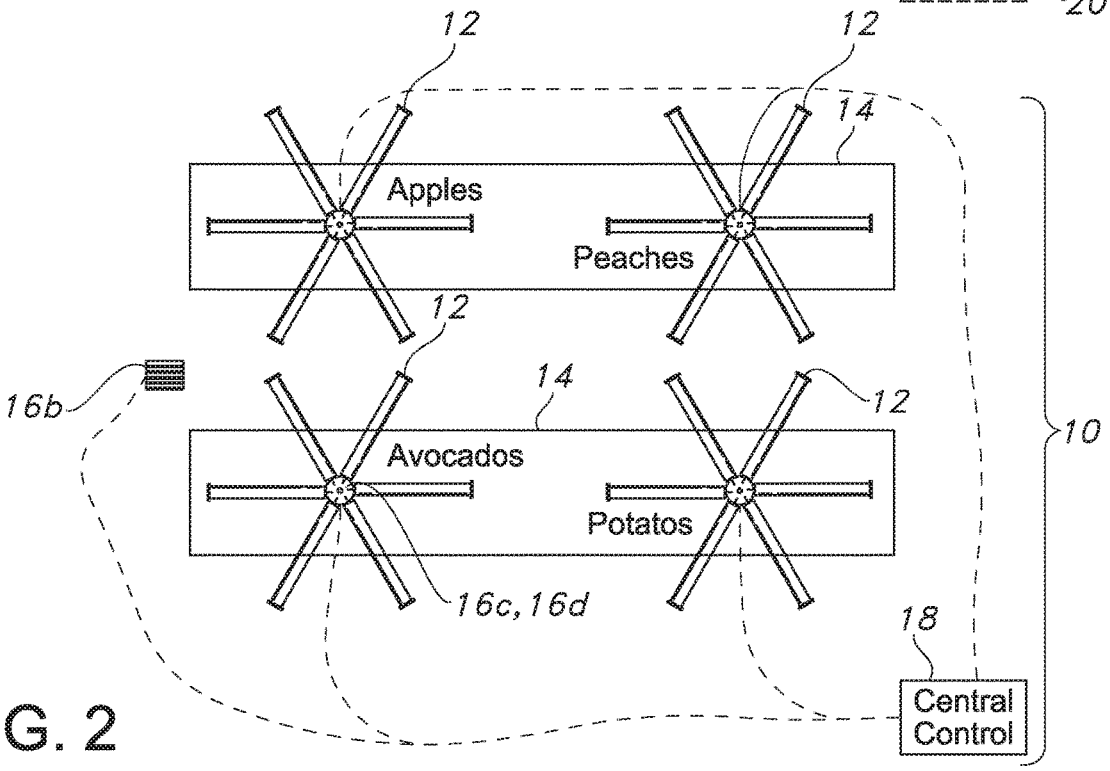
FIG. 2 is a top schematic view of another embodiment of the system.

In some arrangements (such as in warehouse stores without fixed displays), direct sensing of temperature of the product, such as using an embedded sensor, may not be practicable or create the desired results. In such situation, a predictive model of temperature may be used in lieu of a sensor node 16*a* at the display 14. The temperature prediction within a pile of product may be based on a detection of surface temperature of the exposed items in the pile of product. As shown in FIG. 2, the surface temperature may be obtained using a remote sensor, such as an IR sensor 16*c* associated with the fan 12 or otherwise in communication with the control 18 to provide the information necessary to model the temperature within the pile and react accordingly.

Because this system 10 is typically located in a sensitive consumer environment, it may also be desirable to obtain occupancy information in order to prevent discomfort or any adverse impacts on sales psychology. Thus, an occupancy sensor 16*d* (which may be connected to each fan 12) may be used to determine when customers are in the fan's area of influence. Whenever customer motion is detected, the maximum allowable air velocity generated by the fan 12 may be controlled to help ensure comfort is achieved. As noted below, a scheduling input interface to the system 10 may be used to provide information to the system to differentiate between customer motion and employee motion outside of regular business hours.

Part of the system 10 may comprise a central control 18, which may receive the input from the sensor(s) 16 (such as by wired or wireless communication) and control the fan(s) 12 accordingly. As shown in FIG. 1, the central control 18 may also communicate with the HVAC system 20 for regulating the temperature of the associated space. In this manner, the regulation of fan(s) may be coordinated with the operation of the HVAC system 20 in order to achieve the maximum effect on the product from any corresponding regulation of the ambient temperature (which may be by way of a local thermostat, or may be done by central control 18).

The central control 18 may include a user interface that allows for the conditions of the space to be viewed and changed depending on the particular arrangement used or desired. For example, the interface may provide an interactive map preconfigured to replicate the specific product arrangement for a given period of time, such as a typical business day. The user may then indicate the produce varieties to chosen locations under and around fans 12, and the control 18 would respond accordingly by regulating the associated fan(s) 12 based on the type of produce (see, e.g., Examples 1-4 set out below). The control 18 may also make suggestions for layout changes based on similar airflow preferences for the varieties of produce selected. After accepting a final produce layout, the interface may generate a communication to the person who directs the placement of the product on the displays in the space, such as the produce manager. Optionally, the system 10 may include the automated locating of product using electronic (RFID) tags (which may be provided on the pallets associated with the produce) and floor mounted electronic (e.g., RFID) detectors, which may be used by the control 18 to determine the location of the product adjacent to the associated fan and regulate it accordingly.

The system 10 may be programmed to operate in various modes depending on the sensed parameters. For example, in a "Condensation" mode, the system 10 may operate to use the fan(s) 12 to dry off accumulated condensation that occurred in transit between refrigeration (truck or cooler) and a display location. The trigger for this mode may be the system 10 detecting a difference in the display area surface temperature (such as may be read by a sensor 16, including an IR sensor associated with the fan 12) to reading less than a predetermined amount (such as 5° C. above ambient dew point temperature). Upon being triggered, the system 10 may regulate the fan(s) 12 to create the maximum possible air flow for a predetermined time (e.g., 20 minutes).

A related aspect is to operate the system 10 in a second phase of the condensation mode following the first phase described above that seeks to increase surface temperature of product deep within display pile to prevent condensation from forming. This may be done by sensing the inner temperature of the product, such as by using a sensor 16 associated with the display 14 or within a pile of product. When the sensed temperature of the product reaches a predetermined amount (e.g., 1.5° C.) over the ambient dew point temperature, then the speed of the fan 12 may be regulated depending on the occupancy conditions. For example, if it is before the store opening time, the system 10 may operate the fan(s) at a minimum level in order to allow the temperature to increase as desired. If during a time when occupancy is expected, the fan(s) 12 may be set to the minimum speed when no occupancy is detected and set fan to maximum not to cause discomfort whenever occupancy is detected.

Another mode of operation relates to the thermal characteristics of the produce. In a "Heat Dispersion" mode, the purpose is to convectively remove heat generated by respiration and thus decrease over-ripening and microbial growth, which is especially desirable for any produce prone to generating heat and when the air temperature is below produce surface temperature. The trigger for this mode may be a produce surface temperature, which may be directly sensed or predicted, and the system 10 may then regulate the fan(s) to operate at a constant velocity necessary to maintain the sensed temperature within a predetermined range (e.g. 1° C.) over ambient air temperature.

A further "HVAC Fluctuation" mode of operation will involve using information learned from monitoring HVAC usage. For instance, by using temperature drops caused by the HVAC system 20, the system 10 may be operated to use this to cool produce and decrease respiration and microbial activity. This may be done by sensing an ambient temperature in the space where the fan 12 is located, such as in the upper part of the room, and determining if it is less than the produce temperature (whether directly or indirectly determined). If it is determined that the ambient temperature is less than the produce temperature, the fan 12 may be operated at a maximum speed. Likewise, in a related mode, if the system 10 detects a temperature of the produce that is likely to cause spoilage, it may also cause the HVAC system and fan(s) to activate to reduce the temperature.

The system 10 may also operate in a "Gas Dispersion" mode that seeks to prevent over-ripening and associated quality degradation by dispersing ethylene build-up. If a produce type is sensitive to ethylene buildup, produce surface temperature is above a predetermined amount (e.g., 5° C.), and $CO_2$ concentration as sensed by an associated sensor 16 has trended to a peak plateau, then the fan(s) 12 may be operated for a particular time to disperse the ethylene. The operation may be halted after a predetermined time or the detected $CO_2$ concentration is reduced to a particular level.

In a "Moisture" mode of operation, the goal of the system 10 is to maintain a relative humidity level that is detrimental to microbial growth without causing an increased amount (e.g., more than a 2%) of loss in produce moisture. The trigger for this mode may be a sensed relative humidity in the produce that is greater than a target (which may vary depending on the type of produce) plus a predetermined amount (e.g., 10%), or may be done without direct measurements according to a produce-specific predetermined schedule. The system 10 would operate to cycle the fan(s) 12 to a gas dispersion velocity at a duty cycle necessary to limit moisture loss in specific produce variety to 2% in one business day.

The following examples are provided as non-limiting discussions of how the above-identified technology might be applied in connection with particular types of produce.

Example 1

Figure 3:
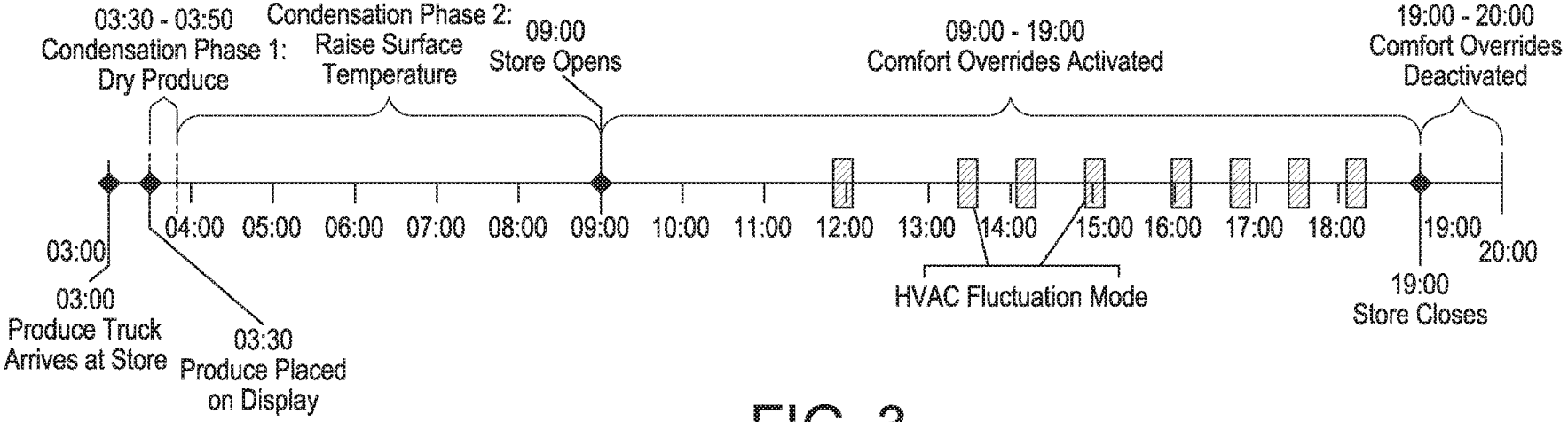
FIGS. 3-6 are timelines illustrating possible uses of the disclosed methods and systems.

This example pertains to potatoes, and is best understood with reference to FIG. 3. Root crops such as potatoes (and onions) have a very large thermal mass and thus resist changes in temperature. For this reason, condensation abatement needs to be especially aggressive, as can be seen in the diagram provided. However, after condensation is avoided, shelf life is reasonably stable and there is no sensitivity or production of ethylene. This is why the example system behavior only includes HVAC Fluctuation Mode after condensation.

Example 2

Figure 4:
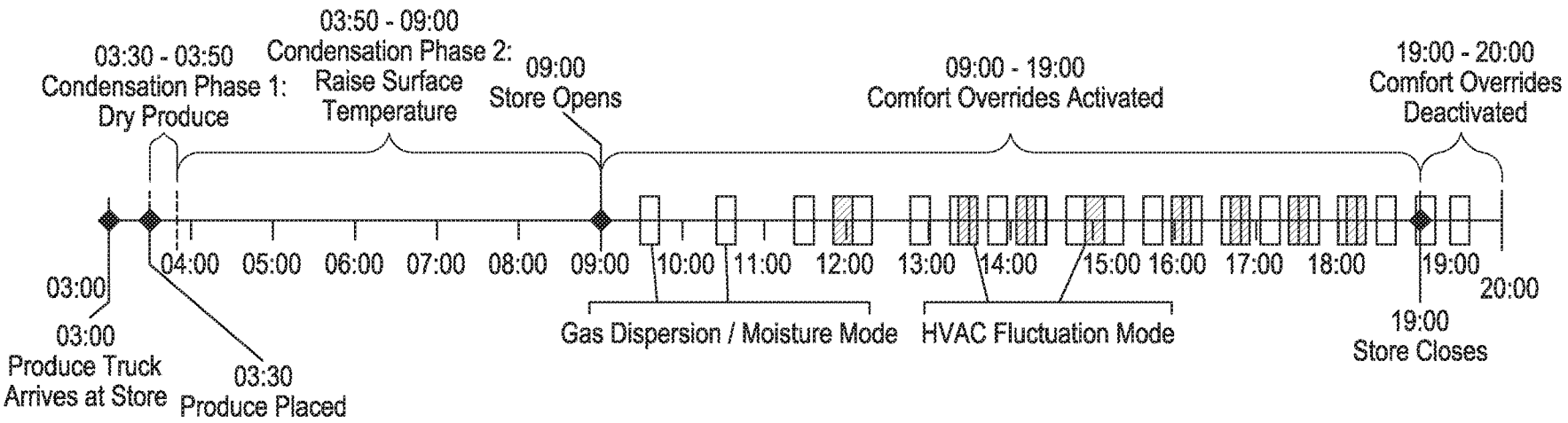

This example pertains to peaches, and is best understood with reference to FIG. 4. Soft skin varieties such as peaches and berries will be strongly affected by condensation due to the permeability of the skin and the availability of nutrients to microbes once hydrated. More care must also be taken with soft skin varieties to avoid over-drying.

Example 3

Figure 5:
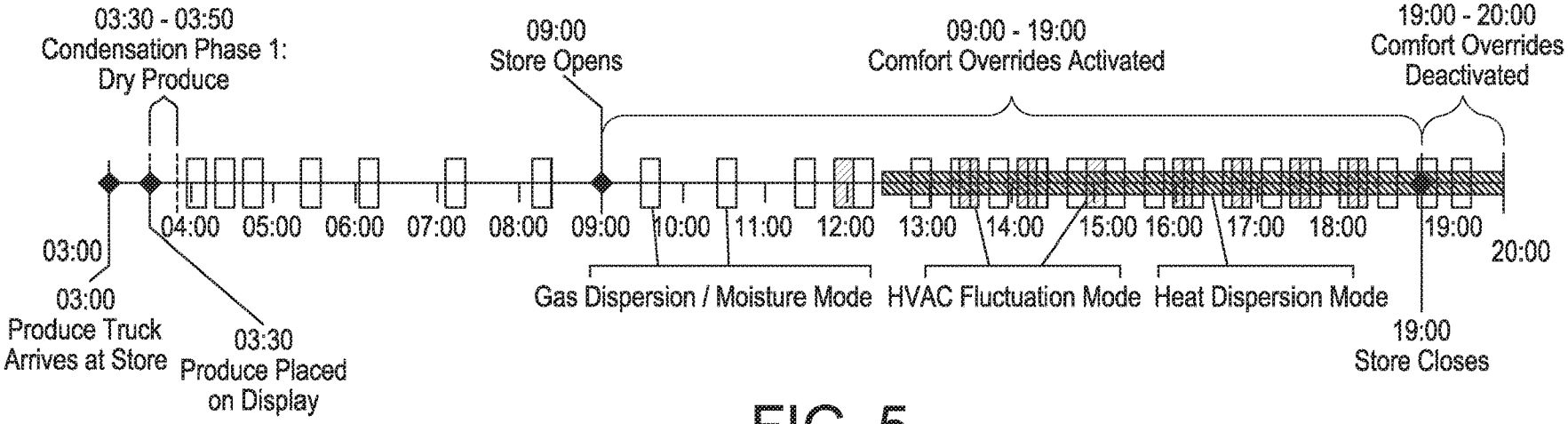

With reference to FIG. 5, this example pertains to avocados, which have very thick and fairly moisture tolerant skin. For this reason, condensation is not a major concern. Also, low temperature prevents ethylene off-gassing and slows ripening; thus, it is beneficial to maintain the initial cold temperature of the produce as long as possible. Accordingly, as can be seen in FIG. 5, initial condensation is dried off at the very beginning and then periodic Moisture Mode is used to prevent liquid buildup without excessively heating the avocados with ambient air. Once the avocado does warm to the point where respiration begins and heat begins to build up, Heat Dispersion Mode is activated.

Example 4

Figure 6:
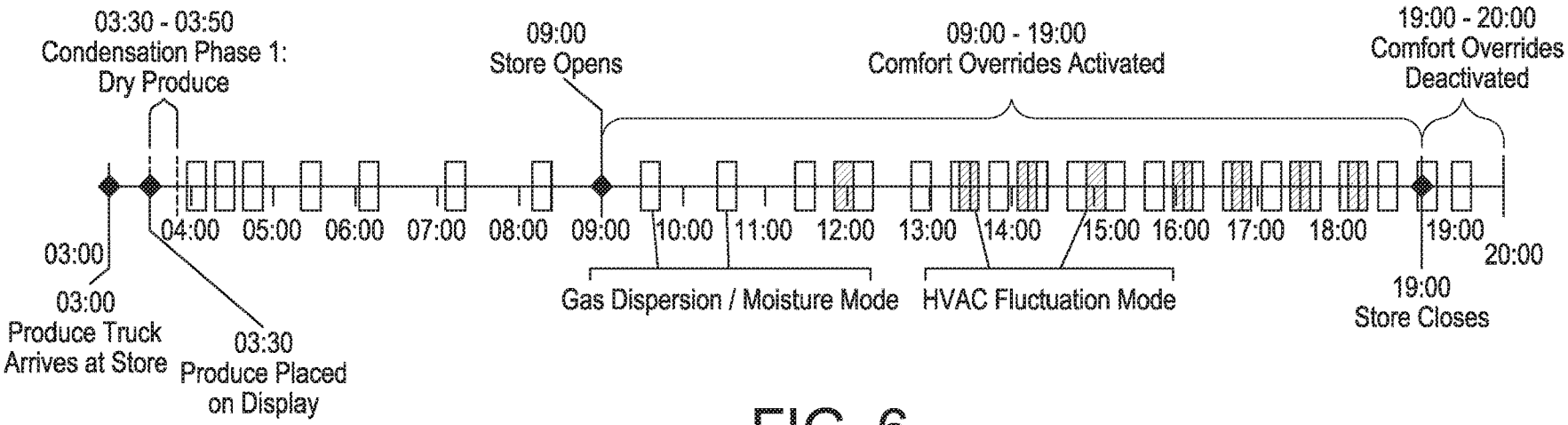

This example relates to apples, which have a similar (but not as extreme) moisture resistance compared to avocados. However, apples do not generate significant amounts of heat and thus a Heat Dispersion Mode is not needed. Otherwise, the treatment is similar, as shown in FIG. 6.

Certain overrides may also be applied to any of the foregoing modes when conditions have been met within the specified time range. For instance, a customer comfort override may be provided during business hours when occupancy is detected. This override would cause system 10 to limit the maximum air velocity at occupant level created by fan(s) to that allowable by ASHRAE standard 55 such that no more than a particular percentage of occupants are dissatisfied and for a given time.

A further override may be provided if air curtains, such as associated with a refrigerated display for displaying product, are present within the area of influence of produce system fans 12. In this override, fan speed may be restricted such that the temperature does not diverge more than a certain amount (e.g., 1° C.) from normal operating temperature (when no fans are present) during the current fan mode. The temperature may be sensed by a sensor associated with the display.

Figure 7:
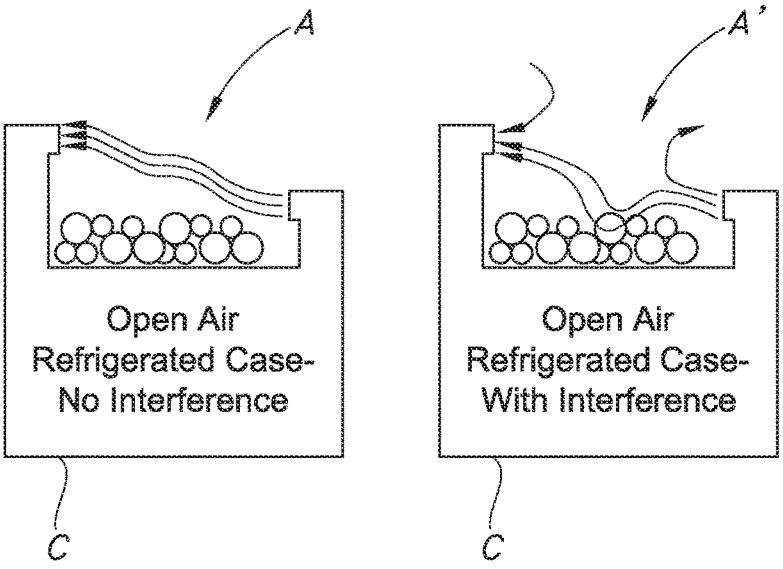
FIG. 7 is a schematic illustration of an open air refrigerated case to which this disclosure may apply.
Figure 8:
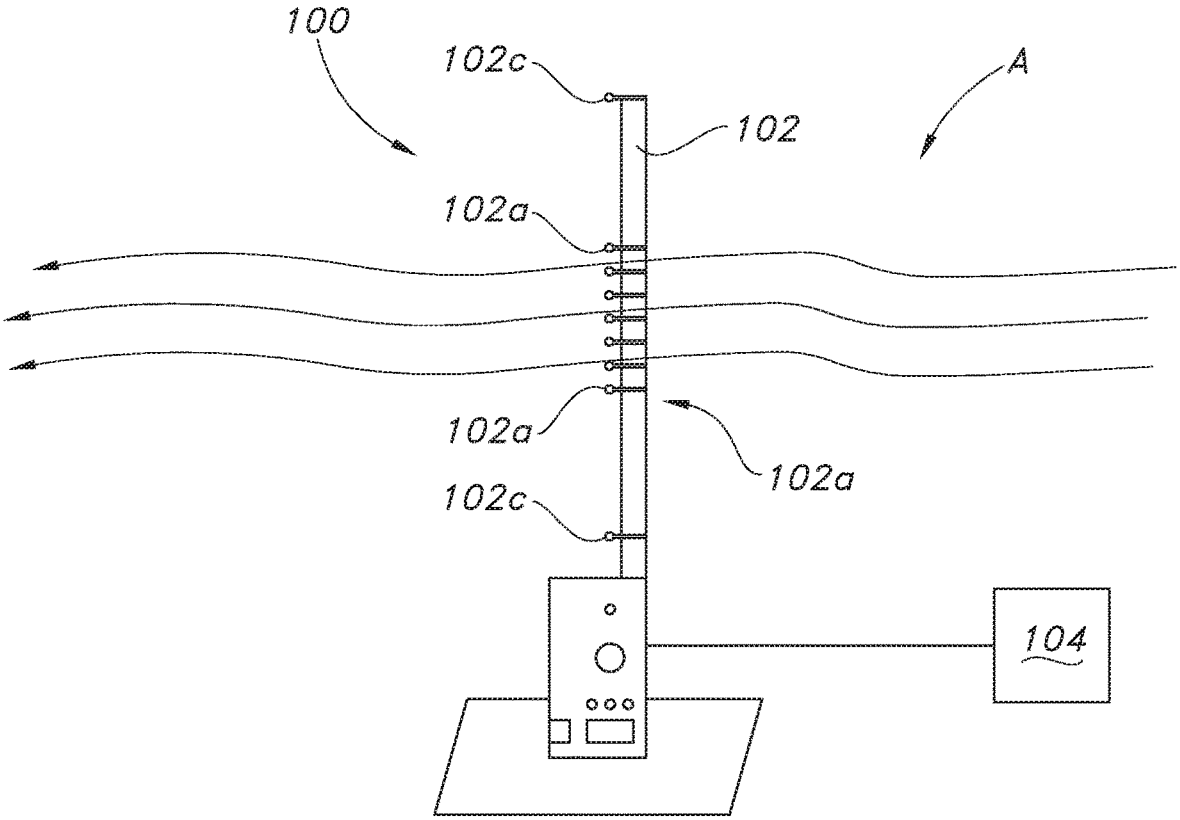
FIG. 8 is a schematic illustration of a sensor probe for use in connection with an air curtain.

In this regard, and with reference to FIGS. 7-10, the disclosure also pertains to a manner in which to minimize interference on refrigerated open air displays as a result of a fan for regulating the flow of air in an associated space. The situation of concern is illustrated in FIG. 7, in which an airflow, such as an air curtain A, is used to create or contain refrigeration for produce or products P in an open air display, such as a case C. The use of fans, such as overhead fans, in an associated space, may cause a disruption in the airflow, such as disrupted air curtain A' indicated on the right hand side of FIG. 7.

In order to account for this disruption and possibly avoid it, a commissioning system 100 is provided which includes a sensor in the form of a probe 102 for determining the influence of external airflow, such as that generated by a fan, on an air curtain. The probe 102 includes a plurality of spaced sensors 102*a* for sensing temperature, which may be strategically placed in the flow of air forming the air curtain A (vertical in the illustrated example). In this exemplary configuration, the probe 102 includes a first group of sensors 102*b* designed to be positioned within the normal air flow boundary forming the air curtain A, and a second group of sensors 102*c* outside of the normal boundary and spaced from the first group (such as, for instance, at a six inch interval). Variations in temperature as a result of fan operation may then be sensed and reported to a controller 104, such as a portable computer, and used to then determine the optimal setting to minimize disruption as a result of fan operation.

Figure 9:
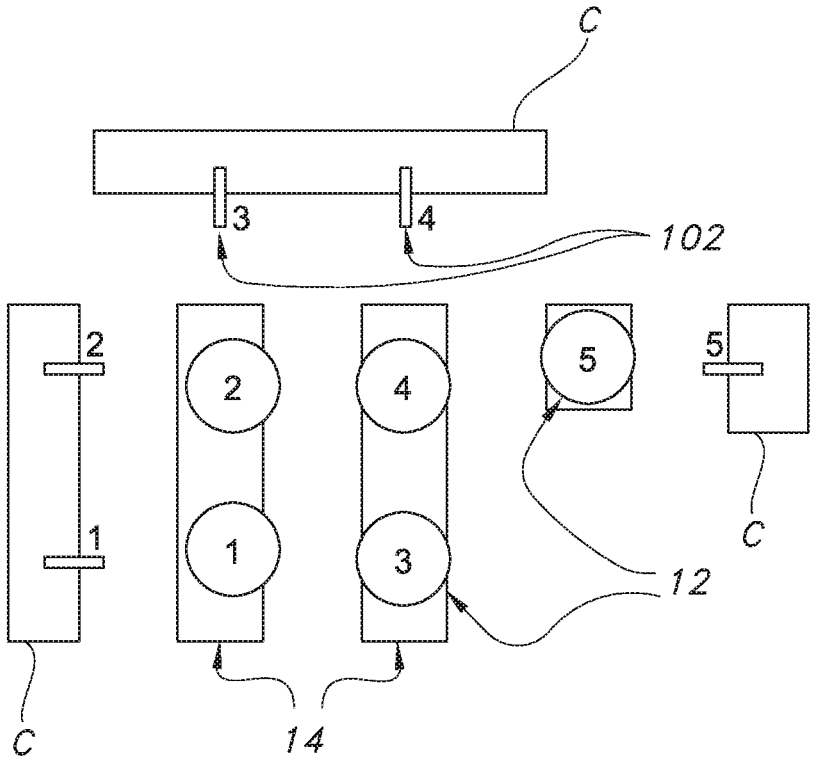
FIG. 9 is a top schematic view of a system used to regulate the operation of fans in spaces with open air refrigerated cases.

One possible use of this system 100 is now described with reference to FIG. 9, which illustrates a typical arrangement of displays 14 including cases C (also considered displays) and adjacent fans 12 (which as noted above may be arranged over displays for displaying produce). Each case C may be associated with one or more probes 102. Each fan 12 is then incrementally adjusted simultaneously from a fan specific baseline speed to a maximum speed (which may be done by controller 104 or manually). Settling time will be provided after every speed adjustment before logging of temperature sensor data using controller 104.

Using the collected data, an inflection point may be determined for each probe/fan/refrigerated case. The fan speed(s) may then be selected to minimize impact on all refrigerated cases under the influence of the fan or fans according to those results. Minimum and maximum fan speeds will be determined based on refrigerated case model specific criteria and the determined fan speed inflection point for that refrigerated case. Keeping fan speeds within these thresholds ensures that sufficient airflow can be provided to the produce while minimizing energy/operational interference on the refrigerated cases.

As an example of the data processing methods that may be used, the applicable sensors 102*a*-102*c* for each probe 102 may be selected and the following methodology applied:

i. Probe(n).Sensor(1) is the most interior sensor to the cooler (where n is the probe number)

ii. Probe(n).Sensor(4) is the most exterior sensor to the cooler iii. Extract the fan off data for analysis iv. Probe(n).Sensor(2) is the sensor with an average temperature closest to 2° F. warmer than the average temperature of Probe(n).Sensor(1)

v. Probe(n).Sensor(3) is the sensor with an average temperature closest to 4° F. warmer than the average temperature of Probe(n).Sensor(1)

vi. Discard data from all other sensors on Probe(n)

vii. Repeat for each probe 1 through n b. Convert continuous data set from each probe into discrete data i. Average Probe(n).Sensor data for all timestamps corresponding to each fan speed. Example data:

| Fan Speed | 1 | 2 | 3 | 4 | 5 | 6 | 7 | 8 | 9 |
|---|---|---|---|---|---|---|---|---|---|
| ProcSensor(1) | 28.2 | 29.3 | 28.5 | 29.9 | 28.8 | 30 | 29.8 | 30.2 | 30.1 |
| ProcSensor(2) | 30.5 | 30.4 | 29.1 | 31.5 | 33.3 | 35.5 | 37.6 | 39.7 | 41.8 |
| ProcSensor(3) | 32.9 | 32.8 | 30.2 | 33.5 | 35.2 | 38.0 | 40.5 | 43.0 | 45.5 |
| ProcSensor(4) | 58.5 | 59.6 | 60.1 | 58.9 | 58.2 | 58.1 | 57.2 | 57.9 | 58.2 |

ii. Nondimensionalize the above data by applying the below equations on all fan speeds 1 through 9 (F):

$$\text{Probe}(n),\ ND(1) = \frac{\text{Probe}(n),\ ProcSensor(2) - \text{Probe}(n),\ ProcSensor(1)}{\text{Probe}(n),\ ProcSensor(4) - \text{Probe}(n),\ ProcSensor(1)}$$

$$\text{Probe}(n),\ ND(2) = \frac{\text{Probe}(n),\ ProcSensor(3) - \text{Probe}(n),\ ProcSensor(1)}{\text{Probe}(n),\ ProcSensor(4) - \text{Probe}(n),\ ProcSensor(1)}$$

| Fan Speed | 1 | 2 | 3 | 4 | 5 | 6 | 7 | 8 | 9 |
|---|---|---|---|---|---|---|---|---|---|
| ND(1) | 8% | 4% | 2% | 6% | 15% | 20% | 28% | 34% | 42% |
| ND(2) | 16% | 12% | 5% | 12% | 22% | 28% | 39% | 46% | 55% |

1. Repeat for each probe 1 to n c. Identify inflection point in Probe(n).ND data i. Given F speed settings in Probe(n).ND data ii. Split Probe(n).ND data into F-3 sequential pairs (1 to nPair, pair(k)), where each piece of the pair must have at least two data points. Probe(n).pair(k).S(1) to Probe(n).pair(k).S(2) and Probe(n).pair(k).S(3) to Probe(n).pair(k).S(4) for each pair k 1. Example: For F=9 speeds, (pair=1) 1-2&3-9, (pair=2) 1-3&4-9 . . . (pair=6) 1-7&8-9. To tie this back to the above nomenclature, pair 1 for probe 2 would be:

Probe(2).pair(1).S(1)=1

Probe(2).pair(1).S(2)=2

Probe(2).pair(1).S(3)=3

Probe(2).pair(1).S(4)=9 iii. Find the equation of the best fit line for each half of all pairs 1. pair(k).m(1) and pair(k).m(2) are the slopes for the first and second half of pair k respectively 2. pair(k).b(1) and pair(k).b(2) are the intercepts for the first and second half of pair k respectively iv. Sum the simple error of both halves of each pair k within probe(n) data $$\text{probe}(n),\ \text{pair}(k),$$

$$\text{error} = \sum_{i=1}^{2}\left(\sum_{j=1}^{probe(n),pair(k),S(2)} |\text{probe}(n),\ ND(i)[j] - [\text{probe}(n),\ \text{pair}(k),\ m(j) * \text{probe}(n),\ \text{speed}(j) + \text{probe}(n),\ \text{pair}(k),\ b(j)]| + \sum_{m=probe(n)pair(k)S(3)} |\text{probe}(n),\ ND(i)[m] - [\text{probe}(n),\ \text{pair}(k),\ m(m) * \text{probe}(n),\ \text{pair}(k),\ b(m)]|\right)$$

v. The pair k that results in the minimum simple error sum is the location of the inflection point for probe (n)

vi. Repeat for all probes, 1 to n d. Identify inflection Speed {probe(n).SpeedInf} i. Check for negligible/catastrophic influence: For a given probe(n), if the difference in intercepts (b) of the resulting inflection point pair are within 0.10 and the difference in the slopes (m) are within 10% per speed increment, then probe(n) is either experiencing negligible or catastrophic influence 1. If the slope of the half pair with most data points is a. less than 3% per speed increment, then fan influence is negligible and intersection speed {SpeedInt} should be the highest speed tested b. else, the influence of the fan is catastrophic and intersection speed {SpeedInt} should be chosen to keep nondimentionalized influence to below 30% ii. Else, find the inflection point of fan speed influence:

$$\text{probe}(n), SpeedInf = \frac{\text{probe}(n), \text{pair}(k), S(2) + \text{probe}(n), \text{pair}(k), S(3)}{2}$$

Figure 10:
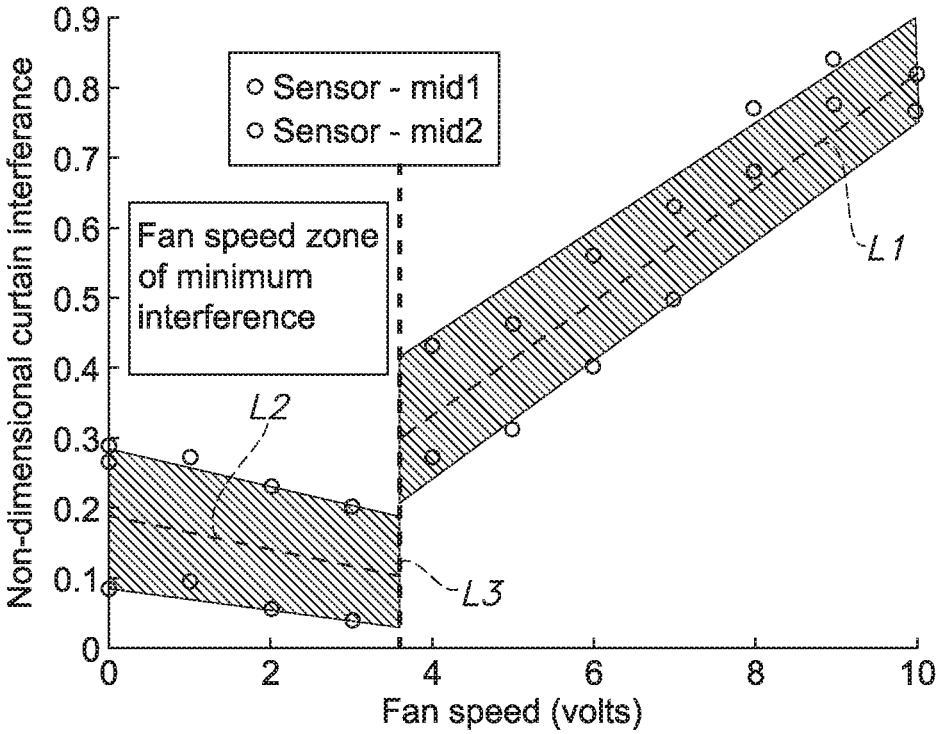
FIG. 10 is a graph illustrating one manner in which the optimal level of fan regulation may be determined.

An exemplary output for a single probe 102 is shown in FIG. 10. The combination of lines L1 and L2 provide the minimum fit error compared to the points. Line L3 represents the fan speed that causes the minimum interference for the associated location.

Having shown and described various embodiments, further adaptations of the apparatuses, methods and systems described herein may be accomplished by appropriate modifications by one of ordinary skill in the art without departing from the scope of the disclosure. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the disclosure should be considered in terms of claims that may be presented, and is understood not to be limited to the details of structure and operation shown and described in the specification and drawings.

The invention claimed is:

1. A system for regulating airflow associated with product for sale in a space, comprising:

a display in the space for displaying the product for sale, wherein the display comprises an open air case;

at least one sensor for sensing a parameter associated with the display and generating an output representative of the parameter;

a ceiling fan over the display; and a controller for controlling the ceiling fan based on the output of the at least one sensor.

2. The system of claim 1, wherein the at least one sensor is connected to the ceiling fan.

3. The system of claim 1, wherein the parameter is selected from the group consisting of air temperature, surface temperature of the product, relative humidity, and $CO_2$ concentration.

4. The system of claim 1, further including a sensor node including the at least one sensor, the node sensing air temperature, surface temperature, relative humidity, and $CO_2$ concentration.

5. The system of claim 1, further including an occupancy sensor for determining the presence of a person adjacent to the display, and wherein the controller overrides the control based on the occupancy sensor output when occupancy is detected.

6. The system of claim 1, further including an HVAC system for conditioning air in the space, the HVAC system being in communication with the controller.

7. The system of claim 1, wherein the at least one sensor senses a surface temperature of the product, and the controller predicts a temperature within a pile of product based on the sensed surface temperature and uses the predicted temperature to regulate the ceiling fan.

8. The system of claim 1, wherein the open air case is refrigerated and includes an air curtain and the controller controls the ceiling fan to avoid disrupting the air curtain.

9. The system of claim 8, wherein the at least one sensor comprises a temperature sensor for positioning at least partially within the air curtain and for sensing temperature as the parameter, and the controller regulates the ceiling fan based on the output of the temperature sensor.

10. A system for regulating airflow associated with product on display for sale in a space, comprising:

a plurality of displays in the space, each for displaying a different type of product for sale;

at least one sensor for sensing a parameter associated with each display and generating an output representative of the parameter;

at least one ceiling fan over each display for regulating an airflow adjacent to each display; and a controller for controlling the ceiling fan over a corresponding display based on the output of the at least one sensor associated with the corresponding display.

11. A system for regulating airflow associated with product for sale in a space, comprising:

a display in the space for displaying the product for sale;

a sensor node including at least one sensor, the node senses air temperature, surface temperature, relative humidity, and $CO_2$ concentration;

an overhead fan located in the space adjacent to the display; and a controller for controlling the overhead fan based on the output of the sensor.

12. A system for regulating airflow associated with product for sale in a space, comprising:

a display in the space for displaying the product for sale;

at least one sensor for sensing a parameter associated with the display and generating an output representative of the parameter;

an overhead fan located in the space adjacent to the display; and a controller for controlling the overhead fan based on the output of the at least one sensor;

wherein the at least one sensor senses a surface temperature of the product, and the controller predicts a temperature within a pile of product based on the sensed surface temperature and uses the predicted temperature to regulate the overhead fan.

* * * * *